US007525046B2

(12) United States Patent
Yang

(10) Patent No.: US 7,525,046 B2
(45) Date of Patent: Apr. 28, 2009

(54) USB CABLE UNIT AND ELECTRONIC DEVICE USING THE SAME

(75) Inventor: Geun-sam Yang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 57 days.

(21) Appl. No.: 11/603,157

(22) Filed: Nov. 22, 2006

(65) Prior Publication Data

US 2007/0141873 A1 Jun. 21, 2007

(30) Foreign Application Priority Data

Dec. 21, 2005 (KR) ..... 10-2005-0127261

(51) Int. Cl.
*H01B 11/02* (2006.01)

(52) U.S. Cl. ..... 174/113 R

(58) Field of Classification Search ..... 174/113 R, 174/117 F

See application file for complete search history.

(56) References Cited

U.S. PATENT DOCUMENTS 5,053,583 A * 10/1991 Miller et al. ..... 174/36
6,211,649 B1 4/2001 Matsuda
6,448,500 B1 * 9/2002 Hosaka et al. ..... 174/113 R
2003/0121694 A1 * 7/2003 Grogl et al. ..... 174/113 R
2007/0068697 A1 * 3/2007 Orfin et al. ..... 174/113 R

FOREIGN PATENT DOCUMENTS

JP 2002-216550 A 8/2002
KR 20-0266081 Y1 2/2002
KR 20-0329963 Y1 10/2003

* cited by examiner

*Primary Examiner*—Chau N Nguyen
(74) *Attorney, Agent, or Firm*—Sughrue Mion, PLLC

(57) ABSTRACT

A USB cable unit for communicatably connecting a first electronic device and a second electronic device, comprises: a first wire part configured to connect the first electronic device and the second electronic device to transmit data therebetween; a second wire part configured to connect the first electronic device and the second electronic device to transmit data therebetween; and a third wire part comprising a power wire configured to connect the first electronic device and the second electronic device to transmit power therebetween, and a pair of ground wires grounded to each other and configured to connect grounds of the first electronic device and the second electronic device. Thus, the present invention provides a USB cable unit and an electronic device using the same supporting USB 2.0 with a high space-efficiency at a low cost.

18 Claims, 6 Drawing Sheets

FIG. 6

| | CON A | WIRE COLOR | CON B | CON A | WIRE COLOR | CON B | |
|---|---|---|---|---|---|---|---|
| 162 | 1 | BLUE | 1 | 7 | BLUE | 7 | 152 |
| 165 | 2 | GND(BLK) | 2 | 8 | WHITE | 8 | |
| 162 | 3 | BLUE | 3 | 9 | GRN | 9 | 145 |
| 165 | 4 | GND(BLK) | 4 | 10 | WHT | 10 | |
| 155 | 5 | GRN | 5 | 11 | WHITE | 11 | 142 |
| | 6 | WHT | 6 | 12 | BLUE | 12 | |

USB CABLE UNIT AND ELECTRONIC DEVICE USING THE SAME

CROSS-REFERENCE TO RELATED APPLICATIONS

This application claims priority from Korean Patent Application No. 2005-0127261, filed on Dec. 21, 2005, in the Korean Intellectual Property Office, the disclosure of which is incorporated herein by reference.

BACKGROUND OF INVENTION

1. Field of Invention

The present invention relates to a USB cable unit and an electronic device using the same and, more particularly, to a USB cable unit and an electronic device using the same supporting USB 2.0.

2. Description of the Related Art

Recently, a universal serial bus (USB) which is convenient, easily extendable and capable of high speed data transmission, has been widely used. The USB has been used for data transmission between a host and a client as well as between a host and various peripheral devices such as an input device, an output device, a scanner, a digital camera, or the like. Also, the USB has been used for data transmission among units within an electronic device. Particularly, since the USB 2.0 can transmit data up to 480 Mbps and is superior to the USB 1.1 as well as compatible with a USB 1.1 device, the USB 2.0 has been extensively used.

FIG. 1 schematically illustrates a related art USB cable unit, and FIG. 2 is a sectional view illustrating the USB cable unit in FIG. 1. In FIGS. 1 and 2, a USB cable unit 101 supports USB 2.0. The USB cable unit 101 includes a pair of power wires 110 and a pair of signal wires 120. The power wires 110 are non-twisted, and comprise a red Vbus wire 112 and a black ground wire 114. The signal wires 120 are twisted, and comprise a green D+ wire 122 and a white D− wire 124.

An inner shield 130 integrally surrounds the power wires 110 and the signal wires 120. The inner shield 130 is formed of aluminized polyester and protects the power wires 110 and the signal wires 120. An outer shield 140 surrounds the inner shield 130, and is formed of 65% or more tinned copper braid to protect the power wires 110 and the signal wires 120 together with the inner shield 130. A covering member 150 surrounds the outer shield 140 to form the outer skin of the USB cable unit 101, and is formed of PVC (polyvinyl chloride). A drain wire 160 is formed of a tinned copper strand. With this configuration, the USB cable unit 101 can accomplish high/full speed to support the USB 2.0.

However, it is difficult to minimize the size of the USB cable unit 101 because of the big diameter required of the USB cable unit of this configuration, which makes it difficult to make slim a flat display device such as an electronic frame or the like, or other electronic devices. Also, the USB cable unit 101 is complicated, expensive and requires a lot of time for manufacturing.

SUMMARY OF THE INVENTION

Accordingly, it is an aspect of the present invention to provide a USB cable unit and an electronic device using the same supporting USB 2.0 with a high space-efficiency at a low cost.

The foregoing and/or other aspects of the present invention can be achieved by providing a USB cable unit for communicably connecting a first electronic device and a second electronic device, comprising: a first wire part configured to connect the first electronic device and the second electronic device to transmit data therebetween; a second wire part configured to connect the first electronic device and the second electronic device to transmit data therebetween; and a third wire part comprising a power wire configured to connect the first electronic device and the second electronic device to transmit power therebetween, and a pair of ground wires ground to each other and configured to connect grounds of the first electronic device and the second electronic device.

According to an aspect of the present invention, the third wire part comprises a third covering member integrally surrounding the power wire and the ground wires, and the ground wires contact each other to allow current to flow therebetween.

According to another aspect of the present invention, the first wire part comprises a pair of first signal wires and a pair of first clock wires respectively configured to connect the first electronic device and the second electronic device, and a first covering member integrally surrounding the first signal wires and the first clock wires, and the second wire part comprises a pair of second signal wires and a pair of second clock wires respectively configured to connect the first electronic device and the second electronic device, and a second covering member integrally surrounding the second signal wires and the second clock wires.

According to another aspect of the present invention, at least one of the first signal wires and the second signal wires are twisted.

According to another aspect of the present invention, at least one of the first clock wires and the second clock wires are non-twisted.

According to another aspect of the present invention, at least one of the first covering member, the second covering member and the third covering member comprise an aluminum tape.

According to another aspect of the present invention, the USB cable unit further comprises a supporting member integrally surrounding the first wire part, the second wire part and the third wire part.

According to another aspect of the present invention, the supporting member comprises aluminum tape.

According to another aspect of the present invention, the first wire part, the second wire part and the third wire part are disposed on a plane.

According to another aspect of the present invention, the first signal wires, the first clock wires, the second signal wires, the second clock wires, and the power wire and the ground wires are disposed on a plane.

The foregoing and/or other aspects of the present invention can be achieved by providing an electronic device comprising a first electronic device, a second electronic device, and a USB cable unit for communicably connecting the first electronic device and the second electronic device, the USB cable unit comprising: a first wire part connecting the first electronic device and the second electronic device to transmit data therebetween; a second wire part connecting the first electronic device and the second electronic device to transmit data therebetween; and a third wire part provided with a power wire connecting the first electronic device and the second electronic device to transmit power therebetween, and a pair of ground wires grounded each other to connect grounds of the first electronic device and the second electronic device.

BRIEF DESCRIPTION OF THE DRAWINGS

The above and/or other aspects of the prevent invention will become apparent and more readily appreciated from the following description of the exemplary embodiments, taken in conjunction with the accompany drawings, in which:

FIG. 6 is a configuration table of the USB cable unit in FIG. 3.

DETAILED DESCRIPTION OF THE EXEMPLARY EMBODIMENTS OF THE INVENTION

Figure 1:
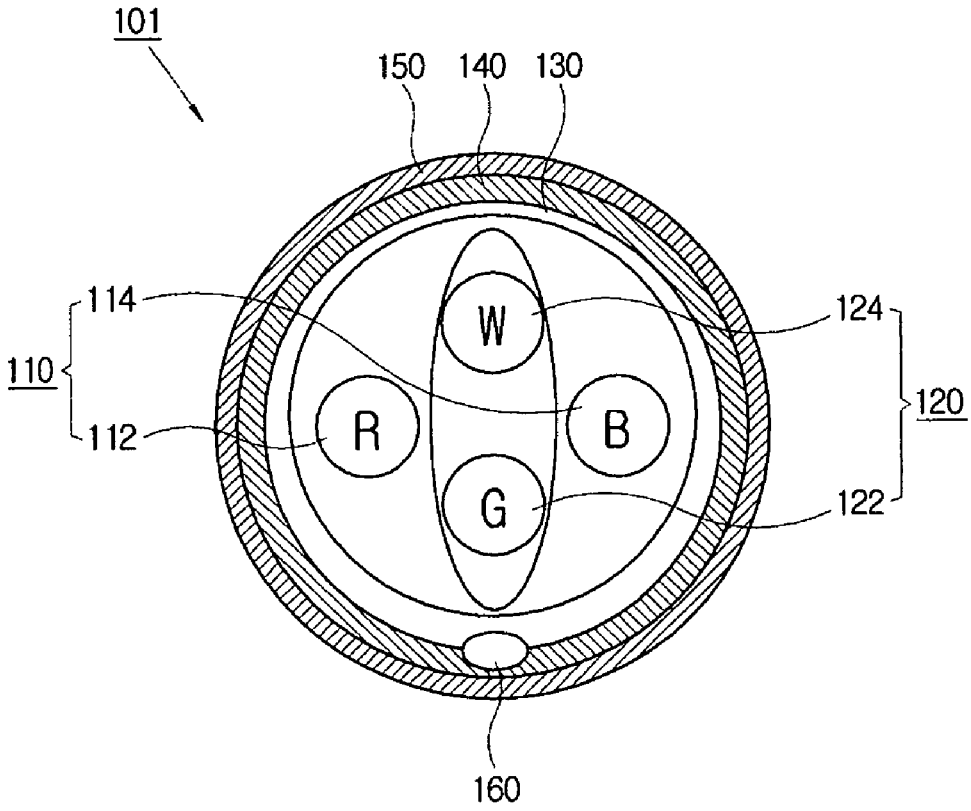
FIG. 1 (Related Art)
FIG. 1 schematically illustrates a related art USB cable unit.
Figure 2:
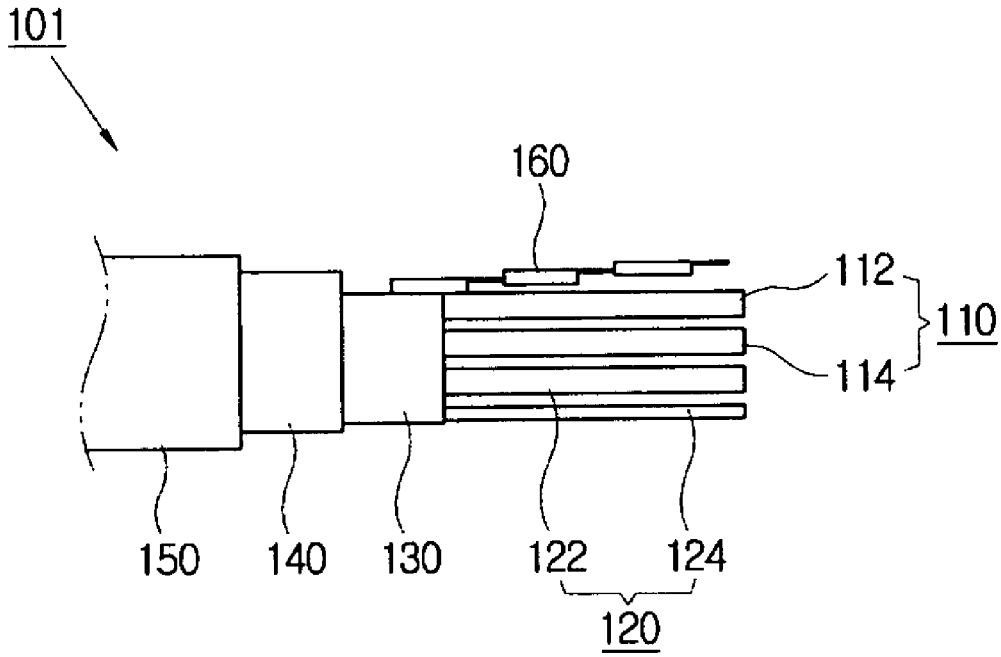
FIG. 2 (Related Art)
FIG. 2 is a sectional view illustrating the USB cable unit in FIG. 1.

Reference will now be made in detail to the exemplary embodiments of the present invention, examples of which are illustrated in the accompanying drawings, wherein like reference numerals refer to like elements throughout. The exemplary embodiments are described below so as to explain the various aspects of the present invention by referring to the figures.

Figure 3:
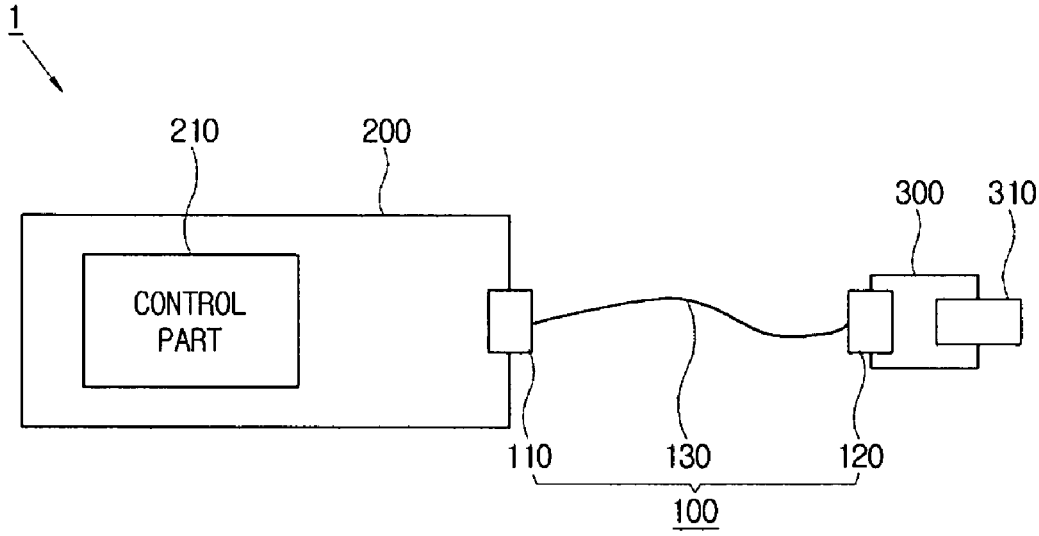
FIG. 3 schematically illustrates an electronic device including a USB cable unit according to an exemplary embodiment of the present invention.

As shown in FIG. 3, an electronic device 1 includes a first electronic device 200, a second electronic device 300 and a USB cable unit 100. The first electronic device 200 includes a control part 210 controlling a driving part 310. The control part 210 may comprise a MICOM or other type of processing unit. The second electronic device 300 includes the driving part 310. The driving part 310 receives a command from the control part 210 or transmits a signal thereto through the USB cable unit 100.

The USB cable unit 100 connects the first electronic device 200 with the second electronic device 300 so that the first electronic device 200 communicates with the second electronic device 300. The USB cable unit 100 includes a first connector 110 connected to the first electronic device 200, a second connector 120 connected to the second electronic device 300, and a connecting part 130 connecting the first connector 110 with the second connector 120. The USB cable unit 100 supports USB 2.0.

For purposes of illustration, the first electronic device 200 is provided as a main printed circuit board installed in the electronic device 1, and the second electronic device 300 is provided as a sub printed circuit board installed therein. Alternatively, the second electronic device 300 may be an external device detachably connected to the electronic device 1. Also, alternatively, the first electronic device 200 and the second electronic device 300 may be embodied as other units that may communicate with each other to perform a function together.

The electronic device 1 may be provided as an electronic frame displaying information. Alternatively, the electronic device 1 may be other flat display devices, or other portable devices such as a note book computer, a mobile telephone, an MP3 player, a digital camera, or the like. Also, alternatively, the electronic device 1 may be other devices using a USB connection.

Figure 4:
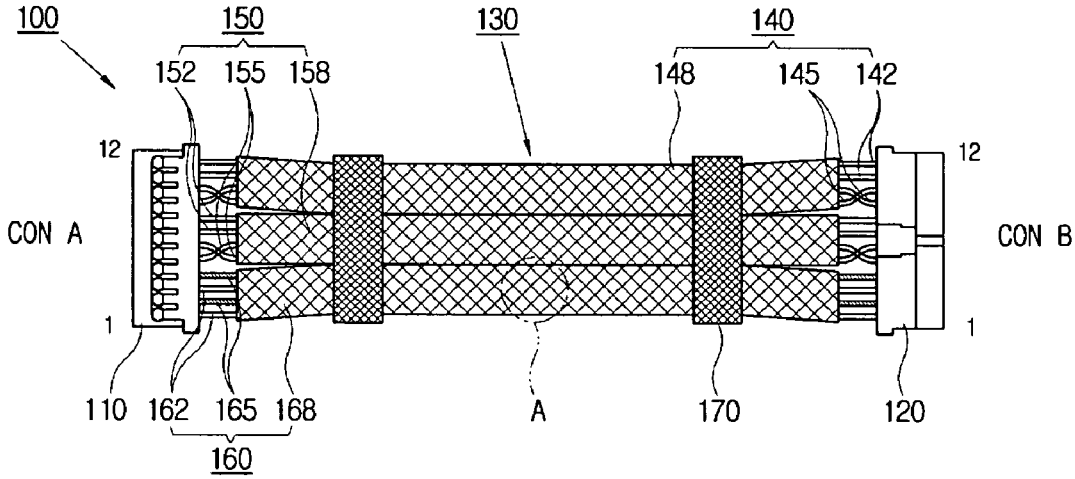
FIG. 4 schematically illustrates the USB cable unit in FIG. 3.
Figure 5:
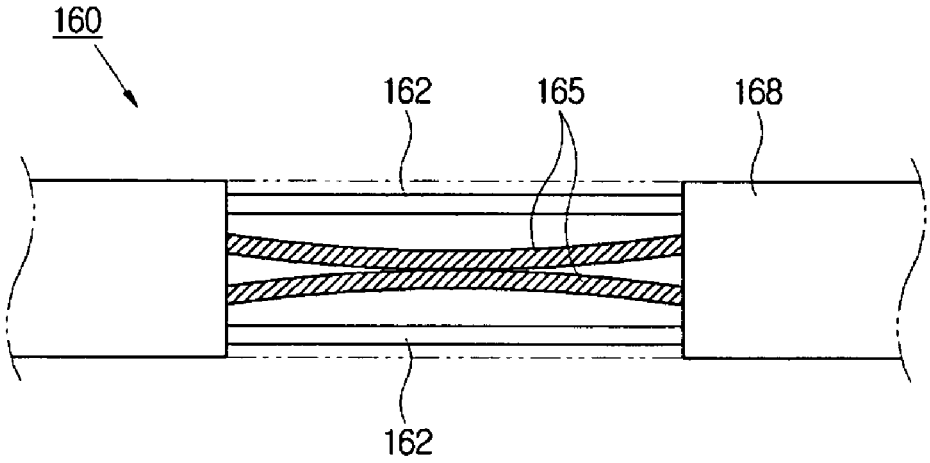
FIG. 5 illustrates a main portion A in FIG. 4, in which a covering member is removed.

FIG. 4 schematically illustrates the USB cable unit 100 of FIG. 3, and FIG. 5 illustrates a main portion A of FIG. 4, in which a covering member is removed. As shown in FIG. 4, the USB cable unit 100 includes the first connector 110, the second connector 120 and the connecting part 130. The connecting part 130 includes a first wire part 140, a second wire part 150, a third wire part 160 and a supporting member 170.

The first wire part 140 includes a pair of first signal wires 145 and a pair of first clock wires 142 respectively connecting the first electronic device 200 with the second electronic device 300, and a first covering member 148 integrally surrounding the first signal wires 145 and the first clock wires 142. The first clock wires 142 are non-twisted. The first signal wires 145 include a D+ wire and a D− wire which are twisted with each other.

The first clock wires 142 and the first signal wires 145 are disposed parallel on a plane. Accordingly, the thickness of the first wire part 140 may be minimized. The first covering member 148 may support the first clock wires 142 and the first signal wires 145 and, additionally, may protect the first clock wires 142 and the first signal wires 145. The first covering member 148 may comprise an aluminum tape or a gasket, or may be formed of other insulating materials.

The second wire part 150 includes a pair of second signal wires 155 and a pair of second clock wires 152 respectively connecting the first electronic device 200 with the second electronic device 300, and a second covering member 158 integrally surrounding the second signal wires 155 and the second clock wires 152. The second clock wires 152 are non-twisted. The second signal wires 155 include a D+ wire and a D− wire which are twisted each other.

The second clock wires 152 and the second signal wires 155 are disposed parallel on a plane. Accordingly, the thickness of the second wire part 150 may be minimized. Also, the second clock wires 152 and the second signal wires 155 may be disposed on the same plane as the first wire part 140, and accordingly, the thickness of the first wire part 140 and the second wire part 150 may be minimized. The second covering member 158 may support the second clock wires 152 and the second signal wires 155 and, additionally, may protect the second clock wires 152 and the second signal wires 155. The second covering member 158 may comprise an aluminum tape or a gasket, or may be formed of other insulating materials. The first wire part 140 and the second wire part 150, respectively, may perform up streaming and down streaming.

The third wire part 160 includes a pair of power wires 162 and a pair of ground wires 165 respectively connecting the first electronic device 200 with the second electronic device 300, and a third covering member 168 integrally surrounding the power wires 162 and the ground wires 165. The power wires 162 transmit power between the first electronic device 200 and the second electronic device 300.

The ground wires 165 connect a ground of the first electronic device 200 with that of the second electronic device 300, and are grounded with each other by being surrounded with the third covering member 168. As illustrated in FIG. 5, the ground wires 165 contact each other, and skins of the contacted portion thereof are removed so that the ground wires 165 are grounded with each other. The power wires 162 and the ground wires 165 are respectively non-twisted.

The power wires 162 and the ground wires 165 are disposed parallel on a plane so that the thickness of the third wire part 160 may be minimized. Also, the power wires 162 and the ground wires 165 are disposed on the same plane as the first wire part 140 and the second wire part 150 so that the total thickness of the connecting part 130 may be minimized. The third covering member 168 may support the power wires 162 and the ground wires 165 and, additionally, protect the power wires 162 and the ground wires 165. The third covering member 168 may comprise an aluminum tape or a gasket, or may be formed of other insulating materials.

The supporting member 170 integrally surrounds the first wire part 140, the second wire part 150 and the third wire part 160 to support the first wire part 140, the second wire part 150 and the third wire part 160. A plurality of the supporting members 170 may be disposed at a various intervals or at predetermined intervals. The supporting member 170 may comprise an aluminum tape or a gasket, or may be formed of other materials.

The USB cable unit 100 may prevent interference according to data transmission by including the first wire part 140, the second wire part 150, the third wire part 160 and the supporting member 170. The USB cable unit 100 may be configured to satisfy a termination impedance and through impedance (TDR) test and high speed specification (e.g., eye diagram, device receiver sensitivity), and accordingly may be configured to satisfy the USB 2.0 specification. Thus, since the thickness of the USB cable unit 100 may be minimized, the USB cable unit 100 may be configures as a plate USB cable which is capable of supporting the USB 2.0, to thereby enable slimming of the electronic device 1. Also, since the configuration of the USB cable unit 100 is simplified in this configuration, the manufacturing cost and the manufacturing time for the USB cable unit 100 may be reduced.

Referring to FIGS. 3 through 5, the first wire part 140, the second wire part 150 and the third wire part 160 are disposed parallel on the same plane, but alternatively, the first wire part 140, the second wire part 150 and the third wire part 160 can be disposed parallel on different planes. Also, the first wire part 140, the second wire part 150 and the third wire part 160 respectively include the four wires, but alternatively, the first wire part 140, the second wire part 150 and the third wire part 160 can include other numbers of wires according to the connect between the first electronic device 200 and the second electronic device 300, or respectively include different numbers of wires. Also, the USB cable unit 100 includes one first wire part 140 and one second wire part 150, but alternatively, at least one of the first wire part 140 and the second wire part 150 may be provided in plural.

FIG. 6 is a configuration table of the USB cable unit in FIG. 3. Here, CON A represents the first connector 110, and CON B represents the second connector 120.

Referring to FIG. 6, the third wire part 160 includes the power wires 162 having a wire 1 and a wire 3, and the ground wires 165 having a wire 2 and a wire 4. The wires 1 and 3 are blue and not twisted with each other, and the wires 2 and 4 are black and not twisted with each other.

The second wire part 150 includes the second signal wires 155 having a wire 5 and a wire 6, and the second clock wires 152 having a wire 7 and a wire 6. The wire 5 is green and the wire 6 is white, and both are twisted with each other. The wire 7 is blue and the wire 8 is white, and both are not twisted with each other.

The first wire part 140 includes the first signal wires 145 having a wire 9 and a wire 10, and the first clock wires 142 having a wire 11 and a wire 12. The wire 9 is green and the wire 10 is white, and both are twisted with each other. The wire 11 is white and the wire 12 is blue, and both are not twisted each other.

A UL1571 wire may be used as the wires 1, 3, 7 and 12, and a UL758 wire may be used as the wires 2 and 4. Also, a UL1589 wire may be used as the wires 5, 6, 9 and 10, and a UL1061 wire may be used as the wires 8 and 11.

As described above, the exemplary embodiments of the present invention provide the USB cable unit and the electronic device using the same supporting the USB 2.0 with a high space-efficiency at a low cost.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A universal serial bus (USB) cable unit for communicatably connecting a first electronic device and a second electronic device, comprising:

a first wire part configured to connect the first electronic device and the second electronic device to transmit data therebetween;

a second wire part configured to connect the first electronic device and the second electronic device to transmit data therebetween; and a third wire part comprising:

a power wire configured to connect the first electronic device and the second electronic device to transmit power therebetween; and a pair of ground wires grounded to each other and configured to connect grounds of the first electronic device and the second electronic device, wherein the power wire and the pair of the ground wires are disposed in parallel on the same plane;

wherein the third wire part comprises a third covering member integrally surrounding the power wire and the ground wires, and wherein the ground wires contact each other to allow current to flow therebetween.

2. The USB cable unit according to claim 1, wherein the first wire part comprises a pair of first signal wires and a pair of first clock wires respectively configured to connect the first electronic device and the second electronic device, and a first covering member integrally surrounding the first signal wires and the first clock wires, and the second wire part comprises a pair of second signal wires and a pair of second clock wires respectively configured to connect the first electronic device and the second electronic device, and a second covering member integrally surrounding the second signal wires and the second clock wires.

3. The USB cable unit according to claim 2, wherein at least one of the first signal wires and the second signal wires are twisted.

4. The USB cable unit according to claim 2, wherein at least one of the first clock wires and the second clock wires are non-twisted.

5. The USB cable unit according to claim 2, wherein at least one of the first covering member, the second covering member and the third covering member comprise an aluminum tape.

6. The USB cable unit according to claim 2, further comprising a supporting member integrally surrounding the first wire part, the second wire part and the third wire part.

7. The USB cable unit according to claim 6, wherein the supporting member comprises aluminum tape.

8. The USB cable unit according to claim 2, wherein the first wire part, the second wire part and the third wire part are disposed on a plane.

9. The USB cable unit according to claim 2, wherein the first signal wires, the first clock wires, the second signal wires, the second clock wires, and the power wire and the ground wires are disposed on a plane.

10. The USB cable unit according to claim 1, wherein the first wire part comprises a pair of first signal wires and a pair of first clock wires respectively configured to connect the first electronic device and the second electronic device, and a first covering member integrally surrounding the first signal wires and the first clock wires, wherein the second wire part comprises a pair of second signal wires and a pair of second clock wires respectively configured to connect the first electronic device and the second electronic device, and a second covering member integrally surrounding the second signal wires and the second clock wires.

11. The USB cable unit according to claim 10, wherein at least one of the first signal wires and the second signal wires are twisted.

12. The USB cable unit according to claim 10, wherein at least one of the first clock wires and the second clock wires are non-twisted.

13. The USB cable unit according to claim 10, wherein at least one of the first covering member, the second covering member and the third covering member comprise an aluminum tape.

14. The USB cable unit according to claim 10, further comprising a supporting member integrally surrounding the first wire part, the second wire part and the third wire part.

15. The USB cable unit according to claim 14, wherein the supporting member comprises an aluminum tape.

16. The USB cable unit according to claim 10, wherein the first wire part, the second wire part and the third wire part are disposed on a plane.

17. The USB cable unit according to claim 10, wherein the first signal wires, the first clock wires, the second signal wires, the second clock wires, and the power wire and the ground wires are disposed on a plane.

18. An electronic device comprising a first electronic device, a second electronic device, and a USB cable unit communicatably connecting the first electronic device and the second electronic device, the USB cable unit comprising:

a first wire part connecting the first electronic device and the second electronic device to transmit data therebetween;

a second wire part connecting the first electronic device and the second electronic device to transmit data therebetween; and a third wire part provided with a power wire connecting the first electronic device and the second electronic device to transmit power therebetween, and a pair of ground wires grounded each other to connect grounds of the first electronic device and the second electronic device, wherein the first wire part, the second wire part and the third wire part are disposed in parallel on the same plane, wherein the third wire part comprises a third covering member integrally surrounding the power wire and the ground wires, and wherein the ground wires contact each other to allow current to flow therebetween.

* * * * *